US007018173B2

(12) United States Patent
Bongrand et al.

(10) Patent No.: US 7,018,173 B2
(45) Date of Patent: Mar. 28, 2006

(54) DEVICE FOR STOPPING IN ROTATION A FIXED BLADE BEARING SECTOR IN A GAS TURBINE CASING

(75) Inventors: Serge Bongrand, Draveil (FR); Alain Henri Daniel Bouron, Lieusaint (FR); Sébastien Georges Roger Goux, Evry (FR); Fabrice Marois, Melun (FR); Jacky Naudet, Bondoufle (FR); Gabriel Radeljak, Le Raincy (FR); Dominique Raulin, Avon (FR)

(73) Assignee: Snecma Moteurs, Paris (FR)

( * ) Notice: Subject to any disclaimer, the term of this patent is extended or adjusted under 35 U.S.C. 154(b) by 78 days.

(21) Appl. No.: 10/489,867

(22) PCT Filed: Oct. 24, 2002

(86) PCT No.: PCT/FR02/03645

§ 371 (c)(1),
(2), (4) Date: Mar. 24, 2004

(87) PCT Pub. No.: WO03/036050

PCT Pub. Date: May 1, 2003

(65) Prior Publication Data

US 2004/0240992 A1 Dec. 2, 2004

(30) Foreign Application Priority Data

Oct. 25, 2001 (FR) ..... 01 13780

(51) Int. Cl.
*F01D 9/02* (2006.01)

(52) U.S. Cl. ..... 415/190; 415/209.2; 415/213.1

(58) Field of Classification Search ..... 415/209.2, 415/209.3, 213.1, 189, 190
See application file for complete search history.

(56) References Cited

U.S. PATENT DOCUMENTS

| | | | | |
|---|---|---|---|---|
| 2,955,800 | A | 10/1960 | True et al. | |
| 3,843,279 | A | 10/1974 | Anthony et al. | |
| 5,211,536 | A * | 5/1993 | Ackerman et al. | 415/177 |
| 6,095,750 | A * | 8/2000 | Ross et al. | 415/189 |
| 6,200,091 | B1 | 3/2001 | Bromann et al. | |

FOREIGN PATENT DOCUMENTS

| | | |
|---|---|---|
| EP | 0 331 837 | 9/1989 |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A device for stopping rotation of a fixed blade bearing sector in a gas turbine casing. Sectors of synchronizing ring blades are maintained against tangential rotational movements by sliding into grooves of a casing by pins passing through perforations in an extension of the two parts. The pins are prevented from accidental removal either by a flexible lock ring or by a locking tab maintained between the two parts when they have been completely assembled.

13 Claims, 3 Drawing Sheets

DEVICE FOR STOPPING IN ROTATION A FIXED BLADE BEARING SECTOR IN A GAS TURBINE CASING

The purpose of this invention is a device for stopping in rotation a fixed blade bearing sector in a gas turbine casing.

The gas turbine casings are usually composed of two complementary sectors each extending by half a turn and provided with a continuous circular groove in which fixed blade support guide vane sectors can be fitted and which extend over smaller portions of the circumference. This device as such leaves sectors free to slide in the casing by sliding together in the groove, which produces wear and noise during operation. This is why a system is provided for stopping these sectors from rotating, and this system has already been used in known devices in different forms. Firstly it is possible to place modules crossing the grooves between the casing sectors, so as to stop the movement of guide vane sectors. This system is simple but it has the disadvantage that it is impossible to install more than two rotation stop means; therefore it only partially corrects the anarchic movement of blade sectors.

It is also planned to individually connect blade sectors to an outer casing using radial extension rods, but it is obvious that this type of construction makes the machine very much more complicated.

The purpose of the invention is a low cost system for stopping rotation very simply and that can be fitted on an existing machine that is to be improved. This system is individually applicable to the guide vane sectors and therefore entirely immobilises sectors if it is provided on every sector, without requiring excessive costs. Another advantage of the invention is that the leak tightness between guide vane sectors is not compromised.

In its most general form, the rotation stop device includes a pair of drillings formed in line in a guide vane sector and the casing respectively, and a pin that fits into the drillings and means of holding the pin in the drillings.

In particular, the drillings may be made through a rim of the guide vane sector and through a groove in the casing into which the rim is pushed in.

The holding means then advantageously comprise a lock ring inserted under the rim in the groove and occupying a recess intersecting the pin; they may also comprise a locking tab projecting from the pin and that stops in contact with the guide vane sector on one side, and the casing on the other side.

It is advantageous if the section of the pin is non-circular and if it is adjusted in a drilling with a corresponding non-circular section.

We will now describe the invention with reference to the following figures.

Figure 1:
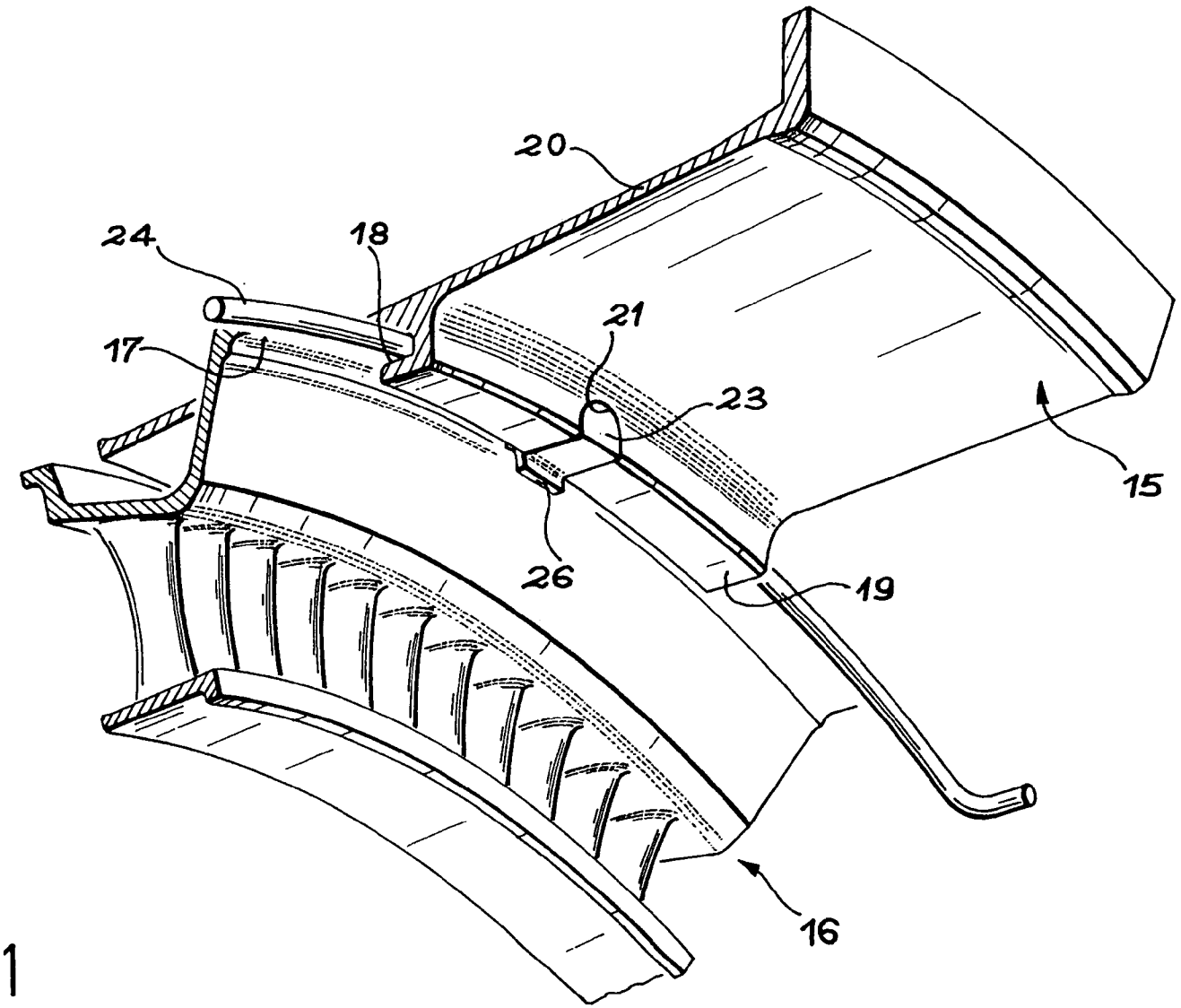
FIG. 1 shows a view of a particular embodiment of the invention.
Figure 4:
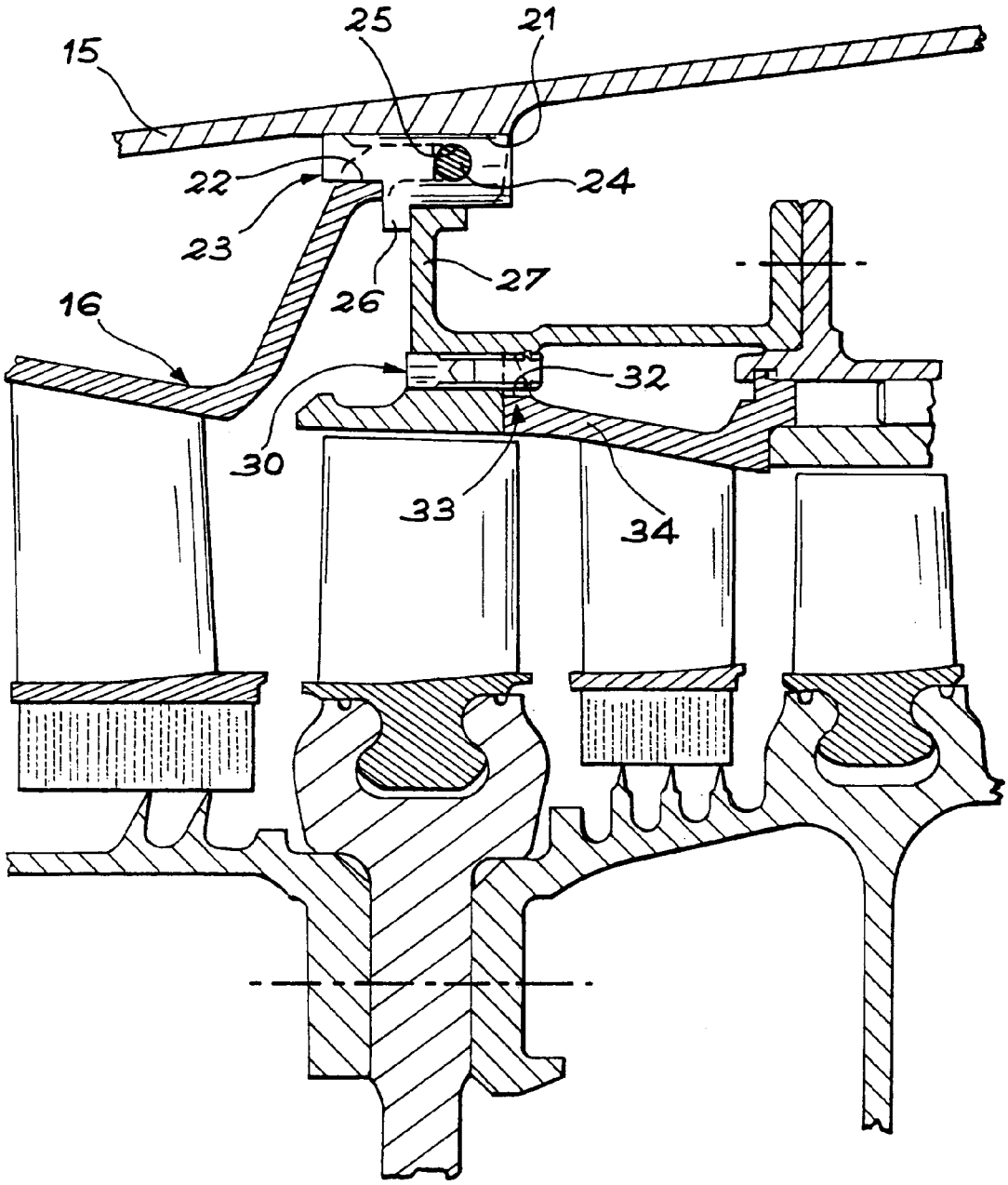
FIG. 4 illustrates the arrangement of the invention in the machine.

FIG. 1 shows a portion of a casing 15 and a guide vane sector 16; the guide vane sector comprises a rim 17 facing an axial direction engaged in a groove 18 made between a hooked portion 19 curved in the other axial direction, and a main cylindrical portion 20 of the casing 15. The casing 15 comprises a drilling 21 passing through the hooked portion 19, and the sector element 16 also comprises a drilling 22 intersecting the rim 17 and prolonging the drilling 21; FIG. 4 helps to better understand the arrangement.

Figure 2:
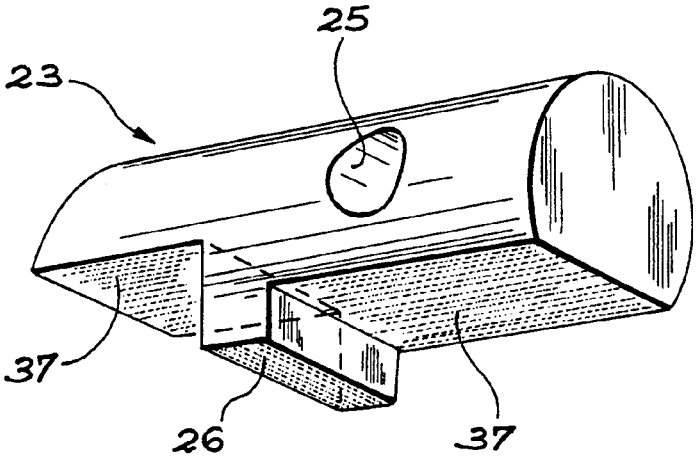
FIG. 2 shows the pin in isolation.

A pin 23, also seen in FIG. 2, fits into drillings 21 and 22 and thus stops rotation of the sector 16 with respect to the casing 15. It is held in place in drillings 21 and 22 by an attachment lock ring 24 engaged in the bottom of the groove 18 under the rim 17, starting from an orifice not shown formed in the hooked part 19, and that passes through a recess 25 in the pin 23. Accidental extraction of the pin 23 may be prevented by a locking tab 26 projecting from the pin 23 and stopping in contact with the casing on one side and in contact with the guide vane sector 16 on the other side. This may be accomplished by joining the guide vane sector 16 to the casing after putting the pin 23 into position in the drillings 21 and 22. The casing 15 is attached to another casing 27 that is radially internal to it, the drilling 21 opens up on the lower side on the other casing 27, and the locking tab 26 comes into contact with the other casing 27, although this does not change anything.

The lock ring 24 is then placed at the bottom of the groove 18; it may extend in front of a series of guide vane sectors 16 and hold the corresponding number of pins 23 in position.

Figure 3:
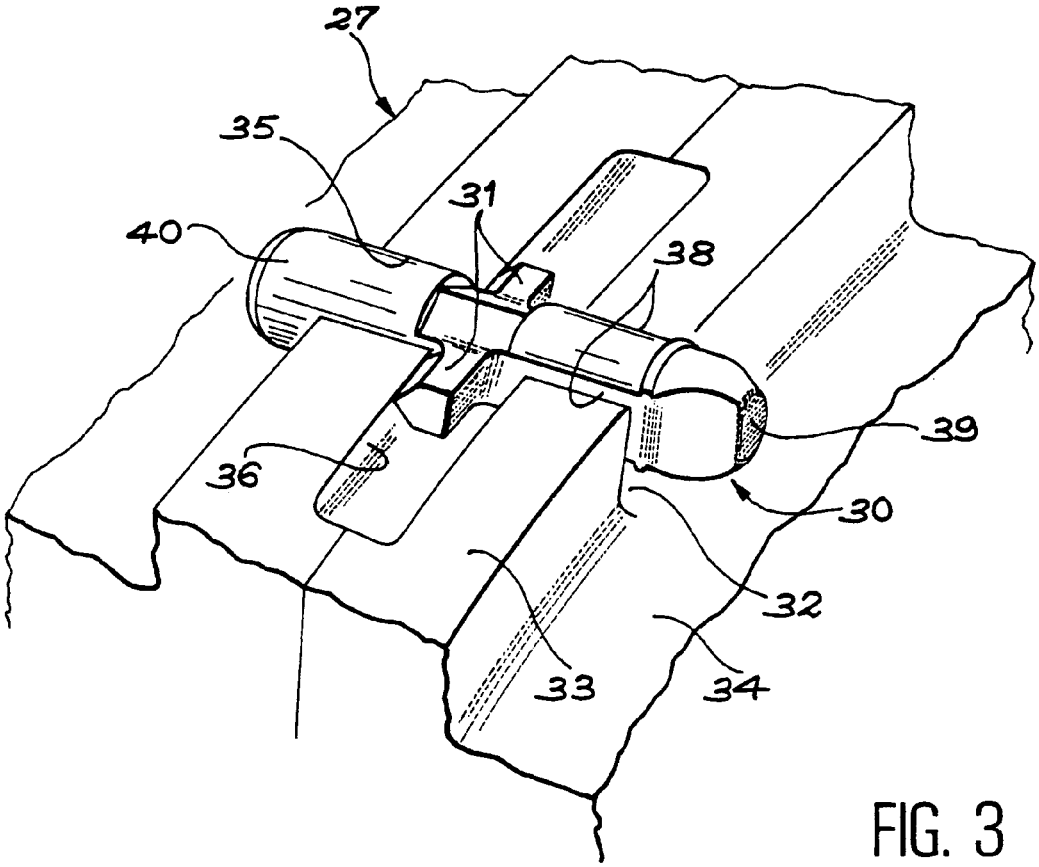
FIG. 3 is a view of a second embodiment of the invention.

Another embodiment, for which the arrangement is also shown in FIG. 4, is shown in FIG. 3 that includes a pin 30 comprising a pair of lateral projections 31. As the previous pin, the pin 30 is engaged in a drilling 32 formed in a rim 33 of a guide vane sector 34, and in a drilling 35 extending the previous drilling and in this case formed through the other casing 27. When the other casing 27 and the guide vane sector 34 are assembled, with the pin 30 previously engaged in the drillings 32 and 35, they enclose a cavity 36 that are occupied by the projections 31, preventing the pin 30 from being extracted. Therefore, the same assembly method is used for pins 23 and 30.

The pins 23 and 30 include non-circular portions such as the plane facets 37 and 38 engaged in one of the drillings 21, 22, 32 and 35, so as to prevent accidental rotation of the pin 23 or 30 that would hinder the assembly; the drillings in which these non-circular portions are engaged obviously have a complementary shaped section. The ends of the pins can be sharpened to facilitate their insertion in drillings; one is marked as reference 39 for pin 30 and is in the shape of a pyramid.

It is obvious that other embodiments are possible, if only by combining some of the elements described for the two embodiments described above in full.

The invention claimed is:

1. A device for stopping rotation of a blade sector of a guide vane in a casing of a gas turbine, comprising:

a pair of drillings formed in line in the blade sector and the casing respectively;

a pin that fits into the drillings; and means for holding the pin in the drillings, wherein the drillings are made through a rim of the blade sector and through a groove in the casing into which the rim is pushed in, and wherein the holding means comprises a lock ring inserted under the rim in the groove and occupying a recess intersecting the pin.

2. A device for stopping rotation of a blade sector of a guide vane in a casing of a gas turbine, comprising:

a pair of drillings formed in line in the blade sector and the casing respectively;

a pin that fits into the drillings; and means for holding the pin in the drillings, wherein the holding means comprises a locking tab projecting from the pin and that stops in contact with the blade sector on a first side, and the casing on a second side.

3. A device according to claim 2, wherein the pin comprises a non-circular section configured to be adjusted in one of the drillings with a corresponding non-circular section.

4. A device for stopping rotation of a blade sector of a guide vane in a casing of a gas turbine, comprising:

a pair of drillings formed in line in the blade sector and the casing respectively;

a pin that fits into the drillings; and a lock ring, wherein the drillings are made through a rim of the blade sector and through a groove in the casing into which the rim is pushed in, and wherein the lock ring is inserted under the rim in the groove and engages a recess intersecting the pin.

5. A device according to claim 4, wherein said lock ring is configured to hold in place said pin.

6. A device according to claim 4, wherein said groove is between a hooked portion and a cylindrical portion of the casing.

7. A device according to claim 6, wherein said drillings pass through said hooked portion.

8. A device according to claim 4, wherein said pin is configured to stop rotation of the blade sector with respect to the casing.

9. A device according to claim 4, wherein said pin has a tab projecting from the pin.

10. A device according to claim 9, wherein said tab is configured to stop in contact with the blade sector on a first side.

11. A device according to claim 10, wherein said tab is configured to stop in contact with the casing on a second side.

12. A device according to claim 9, wherein the pin comprises a non-circular section configured to fit in one of the drillings having a corresponding non-circular section.

13. A device according to claim 4, wherein the pin comprises a non-circular section configured to fit in one of the drillings having a corresponding non-circular section.

* * * * *